US005896789A

United States Patent [19]

Giardino

[11] Patent Number: 5,896,789

[45] Date of Patent: Apr. 27, 1999

[54] RATCHET WRENCH HEAD

[75] Inventor: David A. Giardino, Rock Hill, S.C.

[73] Assignee: Chicago Pneumatic Tool Company, Rock Hill, S.C.

[21] Appl. No.: 08/947,928

[22] Filed: Oct. 9, 1997

[51] Int. Cl.[6] ..... B25B 13/46

[52] U.S. Cl. ..... 81/57.39; 81/57.13; 81/57.29

[58] Field of Search ..... 81/57.39, 57.63, 81/57.29, 57.62, 57.61, 57.13

[56] References Cited

U.S. PATENT DOCUMENTS 4,346,630 8/1982 Hanson ..... 81/57.13
4,791,836 12/1988 D'Haem et al. ..... 81/57.39
5,142,952 9/1992 Putney et al. ..... 81/57.39
5,584,220 12/1996 Darrah et al. ..... 81/57.39

*Primary Examiner*—David A. Scherbel
*Assistant Examiner*—Sinclair Skinner
*Attorney, Agent, or Firm*—Schmeiser, Olsen & Watts

[57] ABSTRACT

The present invention relates generally to pneumatic ratcheting mechanisms and in particular to a device to aid in shank spindle retainment during ratchet resetting. According to the present invention, at least one recess is provided in the shank spindle of a ratchet head to receive a spring therein. The end of the spring is compressed against an interior surface of the ratchet head to frictionally retain the shank spindle and pawl of the ratchet during the resetting stroke of the ratchet yoke.

11 Claims, 3 Drawing Sheets

RATCHET WRENCH HEAD

BACKGROUND OF THE INVENTION

1. Technical Field

The present invention relates generally to pneumatic ratcheting mechanisms and in particular to a device to aid in shank spindle retainment during ratchet resetting.

2. Related Art

Pneumatic ratchets operate by reciprocating movement of a yoke that engages a pawl. The pawl is connected to a shank spindle and is selectively positionable such that the yoke, when it reciprocates, engages the pawl to forcibly turn the pawl and shank spindle in a selected direction. The shank spindle being in turn attached to a workpiece being operated upon.

In the related art, proper operation of the pneumatic ratchets is reliant on temporary frictional retainment of the shank spindle during the non-pawl-engaging resetting stroke of the yoke. For example, in U.S. Pat. No. 4,791,836 to D'Haem et al. (see FIG. 8), incorporated by reference herein, either a single ball bearing or a pair of ball bearings 21, mounted within the shank spindle 24, are spring biased into engagement with a rotationally fixed thrust washer(s) 23 of the ratchet to temporarily retain the shank spindle 24 from rotation while the yoke 17 moves through its reset stroke. This construction, however, has a number of drawbacks. For instance, use of the washers and bearings oftentimes does not adequately prevent rotation of the shank spindle because the bearings tend to have a relatively smooth surface and very low contact area. Furthermore, since the ball bearings may rotate relative to the spring and washers, the springs must be of such force as to maintain the bearings in high compression to prevent rotation. However, because the ball bearings take up space, the strength of the spring is limited to that which will fit between the ball bearings.

It is therefore a feature of the present invention to overcome the above shortcomings.

SUMMARY OF THE INVENTION

The present invention overcomes the above deficiencies by providing a shank spindle with the ball bearings removed, increased size of the spring receiving recesses, and flattened ends on the spring to bear against the interior of the ratchet. As a result, rotation of the shank spindle can be prevented during the non-pawl-engaging reset stroke of the yoke by bearing of the ends of the springs on the interior of the thrust washers. Further, with removal of the ball bearings, more room can be allocated to the springs alone, hence, allowing for increased spring force or strength and improved operation.

The present invention is also drawn to a ratchet mechanism incorporating the shank spindle described above and a method of operation of a ratchet using the above teachings.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

While the present invention will be described for use in fluid driven ratchet mechanisms, one of ordinary skill in the art should recognize that the present invention is not limited to such devices. For instance, the teachings of the present invention can be used in any ratcheting mechanism with or without a fluid driven motor, e.g., a battery operated ratchet.

Figure 1:
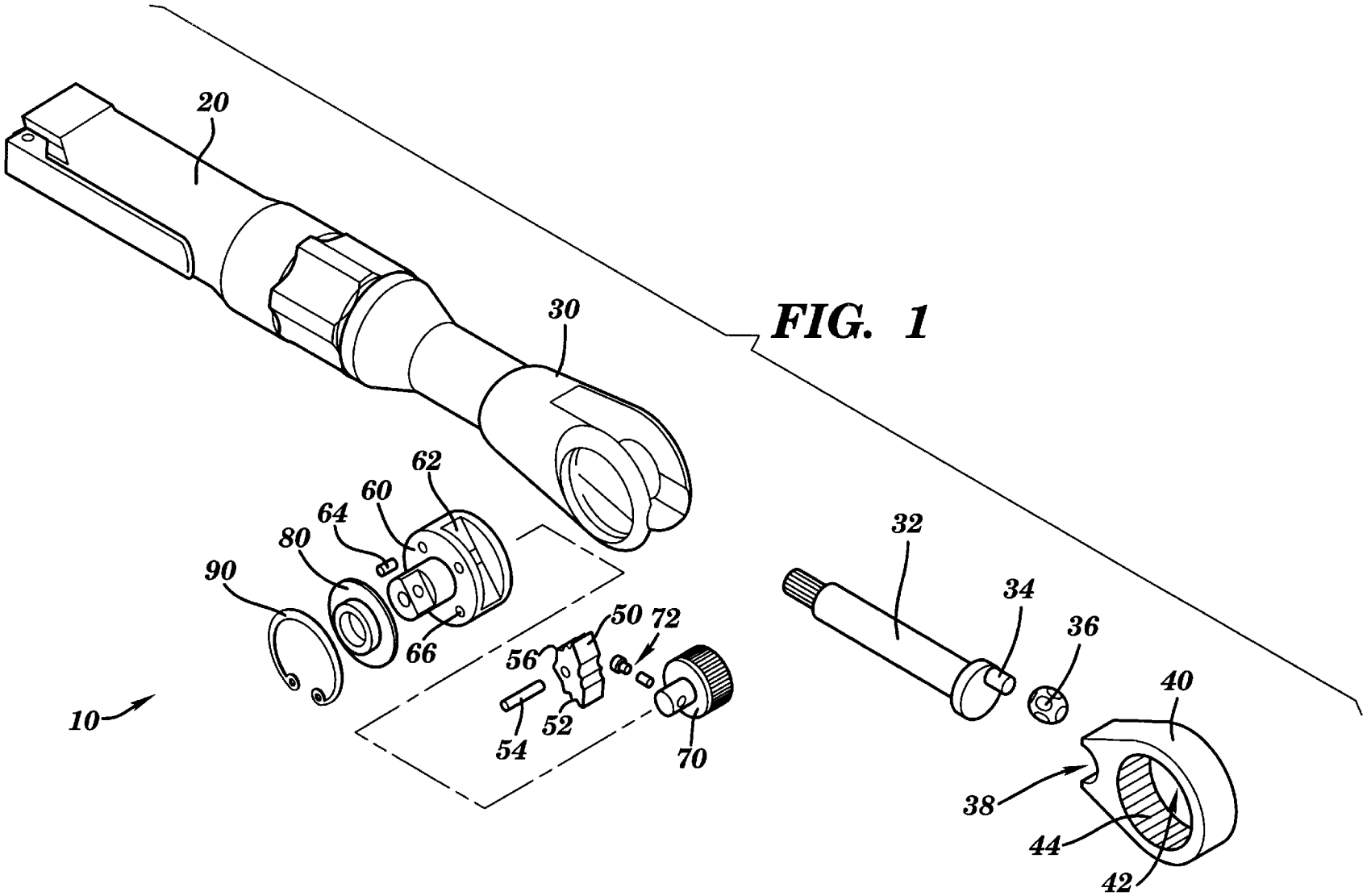
FIG. 1 shows an exploded view of a ratchet in accordance with a preferred embodiment of the present invention.

A ratchet mechanism in accordance with the present invention is shown in FIG. 1. The ratchet mechanism 10 includes a fluid driven motor 20 which rotates an output shaft crank 32 which is housed within a ratchet head 30 attached to the end of the fluid driven motor 20. The shaft crank 32 includes an eccentric end 34 which rotatably holds and turns a drive bushing 36. The drive bushing 36 is received in an opening 38 of the ratchet yoke 40. As the motor rotates the shaft crank 32, the eccentric 34 and drive bushing 36 cause the ratchet yoke 40 to rotationally reciprocate side to side as it is held within the ratchet head 30.

The yoke 40 includes an interior bore 42 that has a plurality of yoke teeth 44 that can selectively engage with either one of a selected set of pawl teeth 52, 56 of a ratchet pawl 50. The sets of pawl teeth 52, 56 are angled in opposite directions (i.e., one in a clockwise direction, the other in a counterclockwise direction) and positioned recessed on the pawl such that only one set of pawl teeth 52, 56 engages the yoke teeth 44 at one time.

The ratchet pawl 50 is positioned in a groove 62 of a shank spindle 60 and is pivotally mounted on a pin 54 in the shank spindle. The position of the pawl 50 and, hence, the set of pawl teeth 52, 56 which engage the yoke teeth 44, is selectable by a reverse knob 70 that extends to an exterior of the ratchet head 30. The pawl 50 is biased to its selected position by a spring biased button 72 of the reverse knob 70 that bears against the pawl.

When the pawl 50 is provided in a first setting, a first set of the pawl teeth 52, 56 engage with the yoke teeth 44 when the yoke 40 rotates in a first direction. As a result, the rotation of the yoke 40 forces the pawl 50 and attached shank spindle 60 to be forcibly rotated in the first direction. Similarly, when the pawl 50 is provided in a second setting, rotation of the yoke 40 in a second direction forces the pawl 50 and attached shank spindle 60 to be forcibly rotated in the second direction. For convenience, the direction of rotation which forces rotation of the pawl 50 and shank spindle 60 is called the force stroke while the return, non-force stroke is called the return stroke.

Figure 7:
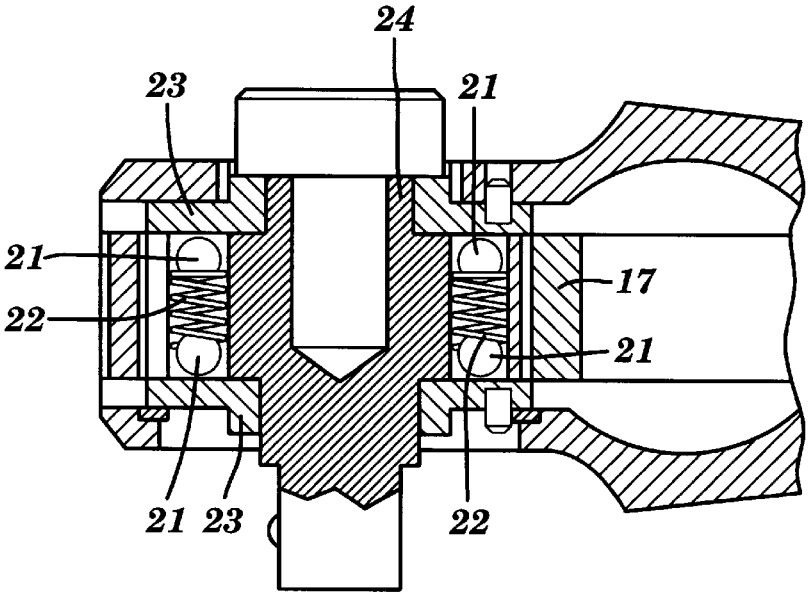
FIG. 7 RELATED ART
FIG. 7 shows a cross-sectional side view of a related art device using ball bearings to prevent rotation of the shank spindle.

For proper operation of the ratchet it is necessary that the yoke teeth 44 and pawl teeth 52, 56 only operatively couple in the selected direction of the yoke 40. Otherwise, forcible rotational movement would be provided in both strokes of the yoke and no work would be provided on the workpiece. To accommodate this situation, related art devices, as discussed above and as shown in FIG. 7, have provided either single or double spring-biased ball bearings 21 in the shank spindle 24 to bear against an interior surface 23 of the ratchet head 30.

Figure 2:
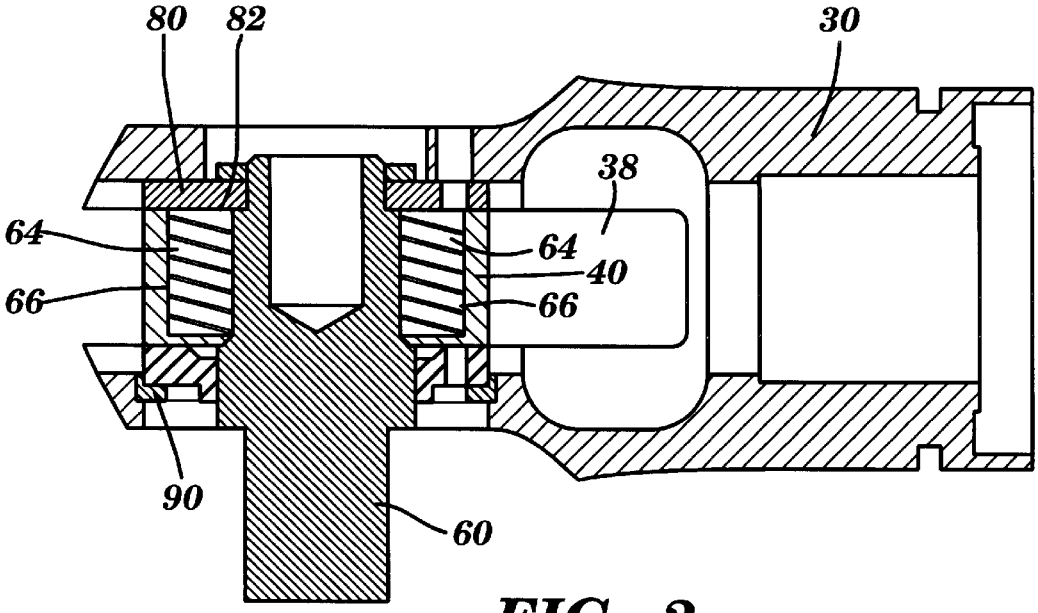
FIG. 2 shows a cross-sectional side view of a shank spindle and ratchet head in accordance with a preferred embodiment of the present invention.

FIG. 2 discloses an improved mechanism to retain the shank spindle 60 and pawl 50 during the resetting stroke of the yoke 40. In accordance with the present invention, recesses 66 are provided in the shank spindle 60 which receive springs 64. The recesses 66, in the form of bores, extend into the shank spindle 60 such that the bore can retain the inner end of the spring 64. The outer end of the spring 64 is preferably flat and alone bears against the surface of the ratchet head 30. The spring 64 being compressed such that sufficient bearing force is provided on the surface to frictionally prevent rotation of the shank spindle 60 and pawl 50 during the resetting stroke of the yoke 40.

The inner surface of the ratchet head 30 is advantageously provided by an interior surface 82 of a thrust washer 80 which also operates to retain the ratchet mechanism in the ratchet head 30 via a retaining ring 90. It should be noted, however, that the springs 65 may also be allowed to bear against an interior surface of the ratchet head 30 such that the thrust washers are not necessary.

Figure 3:
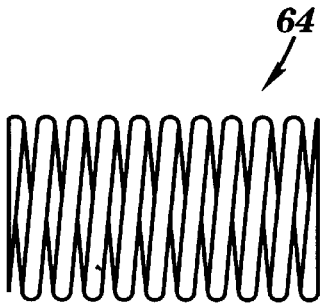
FIG. 3 shows a side view of a first embodiment of a spring component of the ratchet head in accordance with a preferred embodiment of the present invention.
Figure 4:
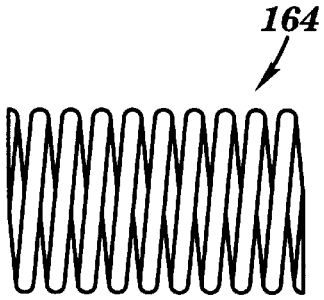
FIG. 4 shows a side view of a second embodiment of a spring component of the ratchet head in accordance with a preferred embodiment of the present invention.
Figure 5:
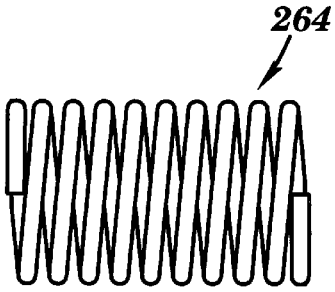
FIG. 5 shows a side view of a third embodiment of a spring component of the ratchet head in accordance with a preferred embodiment of the present invention.
Figure 6:
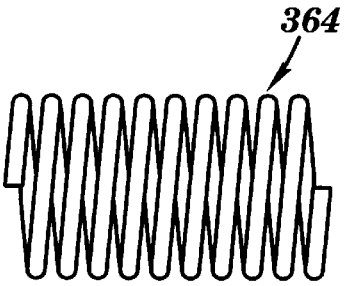
FIG. 6 shows a side view of a fourth embodiment of a spring component of the ratchet head in accordance with a preferred embodiment of the present invention.

It is possible to provide a flat end on the spring in a variety of ways. FIGS. 3–6 show the different embodiments of the spring 64. FIG. 3 shows a spring 64 with ends that are closed, i.e., adjacent the next nearest interior coil, and grounded, i.e., flattened off by a grinding stone or like tool. FIG. 4 shows a spring 164 with ends that are open, i.e., distanced from the next nearest interior coil, and grounded. FIG. 5 shows a spring 264 with closed, non-grounded ends. FIG. 6 shows a spring 364 with open, non-grounded ends.

While the present invention is shown with just two spring mechanisms in the shank spindle, it should be noted that the number may be varied according to the required amount of friction to retain the shank spindle and pawl. Furthermore, as noted above, the compression force or strength of the springs 64 may be varied to accommodate differing sized tools, etc.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

I claim:

1. A shank spindle for use in a fluid driven ratchet, the shank spindle comprising:

at least one recess therein; and a flat ended spring positioned within each recess.

2. The shank spindle of claim 1, wherein the shank spindle includes at least two recesses.

3. The shank spindle of claim 2, wherein the recesses are bores extending into the shank spindle.

4. A ratchet mechanism for use on a ratchet, the mechanism comprising:

a yoke including a toothed interior bore;

a shank spindle including at least one recess therein;

a pawl connected to the shank spindle and including teeth to engage the toothed interior of the yoke;

a non-movable surface on the ratchet; and a spring positioned within each recess and bearing against the non-movable surface to prevent rotation of the shank spindle during a resetting stroke of the yoke.

5. The ratchet mechanism of claim 4, wherein the yoke is operatively attached to a motor to reciprocate.

6. The ratchet mechanism of claim 4, wherein the spring includes a flat end which bears against the non-movable surface.

7. The ratchet mechanism of claim 4, wherein the shank spindle includes at least two recesses.

8. The ratchet mechanism of claim 4, wherein the recess is a bore that extends into the shank spindle.

9. The ratchet mechanism of claim 4, wherein the surface is provided by a non-movable thrust washer positioned adjacent the shank spindle.

10. The ratchet mechanism of claim 4, in combination with a pneumatic ratchet device comprising:

a pneumatic motor;

an output shaft rotatably connected to the pneumatic motor;

an eccentric connected to an end of the output shaft; and a drive bushing rotatably mounted on the eccentric and operatively received in the yoke to reciprocally drive the yoke.

11. A method of preventing shank spindle motion in a ratchet mechanism during yoke resetting motion, the method comprising the steps of:

providing at least one recess in the shank spindle;

bearing an end of a spring positioned within each recess against a non-movable surface of the ratchet.

* * * * *